US006733172B2

(12) United States Patent
Lee et al.

(10) Patent No.: US 6,733,172 B2
(45) Date of Patent: May 11, 2004

(54) MAGNETOHYDRODYNAMIC (MHD) DRIVEN DROPLET MIXER

(75) Inventors: Abraham P. Lee, Irvine, CA (US); Asuncion V. Lemoff, Union City, CA (US); Robin R. Miles, Danville, CA (US)

(73) Assignee: The Regents of the University of California, Oakland, CA (US)

( * ) Notice: Subject to any disclaimer, the term of this patent is extended or adjusted under 35 U.S.C. 154(b) by 143 days.

(21) Appl. No.: 10/096,788

(22) Filed: Mar. 11, 2002

(65) Prior Publication Data

US 2003/0169637 A1 Sep. 11, 2003

(51) Int. Cl.[7] ..... B01F 13/08

(52) U.S. Cl. ..... 366/341; 366/165.1; 366/348; 417/48; 417/50

(58) Field of Search ..... 210/512.1, 787; 494/37; 366/165.1, 165.2, 165.4, 336, 340, 341, 348; 417/46, 50, 53, 244

(56) References Cited

U.S. PATENT DOCUMENTS

| | | | | |
|---|---|---|---|---|
| 4,818,185 A | | 4/1989 | Alexeff | |
| 4,906,877 A | | 3/1990 | Ciaio | |
| 5,181,016 A | | 1/1993 | Lee | |
| 5,560,543 A | | 10/1996 | Smith et al. | |
| 5,669,433 A | | 9/1997 | Sterett et al. | |
| 5,795,457 A | | 8/1998 | Pethig et al. | |
| 5,810,988 A | | 9/1998 | Smith, Jr. et al. | |
| 5,842,787 A | * | 12/1998 | Kopf-Sill et al. | 366/340 |
| 5,876,187 A | | 3/1999 | Forster et al. | |
| 5,876,615 A | | 3/1999 | Predetechensky | |
| 5,925,324 A | | 7/1999 | Greer | |
| 6,146,103 A | | 11/2000 | Lee et al. | |
| 6,154,226 A | | 11/2000 | York et al. | |

FOREIGN PATENT DOCUMENTS

| | | |
|---|---|---|
| WO | WO 96/15576 | 5/1996 |
| WO | WO 96/42004 | 12/1996 |
| WO | WO 97/25152 | 7/1997 |
| WO | WO 98/14272 | 4/1998 |

OTHER PUBLICATIONS

PGPUB Document US2003/0123322, Chung et al, published Jul. 3, 2003.*

Morris, C. J., et al., "Optimization of a circular piezoelectric bimorph for a micropump driver," J. Micromech. Microeng. 10 (2000), pp. 459–465, IOP Publishing Ltd., UK.

(List continued on next page.)

*Primary Examiner*—Joseph Drodge
(74) *Attorney, Agent, or Firm*—Eddie E. Scott; Alan H. Thompson

(57) ABSTRACT

A magnetohydrodynamic fluidic system mixes a first substance and a second substance. A first substrate section includes a first flow channel and a first plurality of pairs of spaced electrodes operatively connected to the first flow channel. A second substrate section includes a second flow channel and a second plurality of pairs of spaced electrodes operatively connected to the second flow channel. A third substrate section includes a third flow channel and a third plurality of pairs of spaced electrodes operatively connected to the third flow channel. A magnetic section and a control section are operatively connected to the spaced electrodes. The first substrate section, the second substrate section, the third substrate section, the first plurality of pairs of spaced electrodes, the second plurality of pairs of spaced electrodes, the third plurality of pairs of spaced electrodes, the magnetic section, and the control section are operated to move the first substance through the first flow channel, the second substance through the second flow channel, and both the first substance and the second substance into the third flow channel where they are mixed.

5 Claims, 4 Drawing Sheets

OTHER PUBLICATIONS

Lemoff, A.V., "Field Driven Microfluidic Actuators for Micro Total Analysis Systems: Magnetohydrodynamic Micropump and Microfluidic Switch, Electrostatic DNS Extractor, Dielectrophorertic DNS Sorter, " Dissertation for degree of Doctor of Philosophy, University of California Davis, (Jun. 2000), 97 pages.

TSAI, Jr–Hung, et al., "A Thermal Bubble Actuated Micro Nozzle–Diffuser Pump," IEEE, (2001), pp. 409–412.

Stenne. E. et al., "A valveless diffuser/nozzle–based fluid pump," Sensors and Actuators A., 39 (1993), pp. 159–167, Elsevier Sequoiz.

LEMOFF, et al., "An AC magnetohydrodynamic micropump," Sensors and Actuators B Chemical B 63, (2000), pp. 178–185, Elsevier Science S.A.

* cited by examiner

MAGNETOHYDRODYNAMIC (MHD) DRIVEN DROPLET MIXER

The United States Government has rights in this invention pursuant to Contract No. W-7405-ENG-48 between the United States Department of Energy and the University of California for the operation of Lawrence Livermore National Laboratory.

BACKGROUND

1. Field of Endeavor

The present invention relates to microfluidics and more particularly to ma magnetohydrodynamic (MHD) driven microfluidic system.

2. State of Technology

Microfluidics is the science of designing, manufacturing, and formulating devices and processes that deal with volumes of fluid on the order of nanoliters (symbolized nl and representing units of $10^{-9}$ liter) or picoliters (symbolized pl and representing units of $10^{-12}$ liter). The devices themselves have dimensions ranging from millimeters (mm) down to micrometers ($\mu$m), where 1 $\mu$m=0.001 mm. Microfluidics hardware requires construction and design that differs from macroscale hardware. It is not generally possible to scale conventional devices down and then expect them to work in microfluidics applications. When the dimensions of a device or system reach a certain size, as the scale becomes smaller, the particles of fluid, or particles suspended in the fluid, become comparable in size with the apparatus itself. This dramatically alters system behavior. Capillary action changes the way in which fluids pass through microscale-diameter tubes, as compared with macroscale channels. In addition, there are unknown factors involved, especially concerning microscale heat transfer and mass transfer, the nature of which only further research can reveal.

The volumes involved in microfluidics can be understood by visualizing the size of a one-liter container, and then imagining cubical fractions of this container. A liter is slightly more than one U.S. fluid quart. A cube measuring 100 mm (a little less than four inches) on an edge has a volume of one liter. Imagine a tiny cube whose height, width, and depth are 1/1000 (0.001) of this size, or 0.1 mm. This is the size of a small grain of table sugar; it would take a strong magnifying glass to resolve it into a recognizable cube. That cube would occupy 1 nl. A volume of 1 pl is represented by a cube whose height, width, and depth are 1/10 (0.1) that of a 1-nl cube. It would take a powerful microscope to resolve that.

Microfluidic systems have diverse and widespread potential applications. Some examples of systems and processes that can employ this technology include inkjet printers, blood-cell-separation equipment, biochemical assays, chemical synthesis, genetic analysis, drug screening, electrochromatography, surface micromachining, laser ablation, and mechanical micromilling. Not surprisingly, the medical industry has shown keen interest in microfluidics technology.

Magnetohydrodynamics (or MHD) is the theory of the macroscopic interaction of electrically conducting fluids with a magnetic field. Magnetohydrodynamics applies the Lorentz force law on fluids to propel or pump fluids. Under the Lorentz force law, charged particles moving in a uniform magnetic field feel a force perpendicular to both the motion and the magnetic field. In the viscous incompressible case, MHD flow is governed by the Navier-Stokes equations and the pre-Maxwell equations of the magnetic field. The latter will in general transcend the region of conducting fluid and, ideally, extend to all of space. It is mostly this feature, the electromagnetic interaction of the fluid with the outside world, which gives rise to challenging problems of mathematical analysis and numerical approximation.

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a magnetohydrodynamic fluidic system for mixing a first substance and a second substance. A first substrate section includes a first flow channel and a first plurality of pairs of spaced electrodes operatively connected to the first flow channel. A second substrate section includes a second flow channel and a second plurality of pairs of spaced electrodes operatively connected to the second flow channel. A third substrate section includes a third flow channel and a third plurality of pairs of spaced electrodes operatively connected to the third flow channel. A magnetic section and a control section are operatively connected to the spaced electrodes. The first substrate section, the second substrate section, the third substrate section, the first plurality of pairs of spaced electrodes, the second plurality of pairs of spaced electrodes, the third plurality of pairs of spaced electrodes, the magnetic section, and the control section are operated to move the first substance through the first flow channel, the second substance through the second flow channel, and both the first substance and the second substance into the third flow channel where they are mixed.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1:
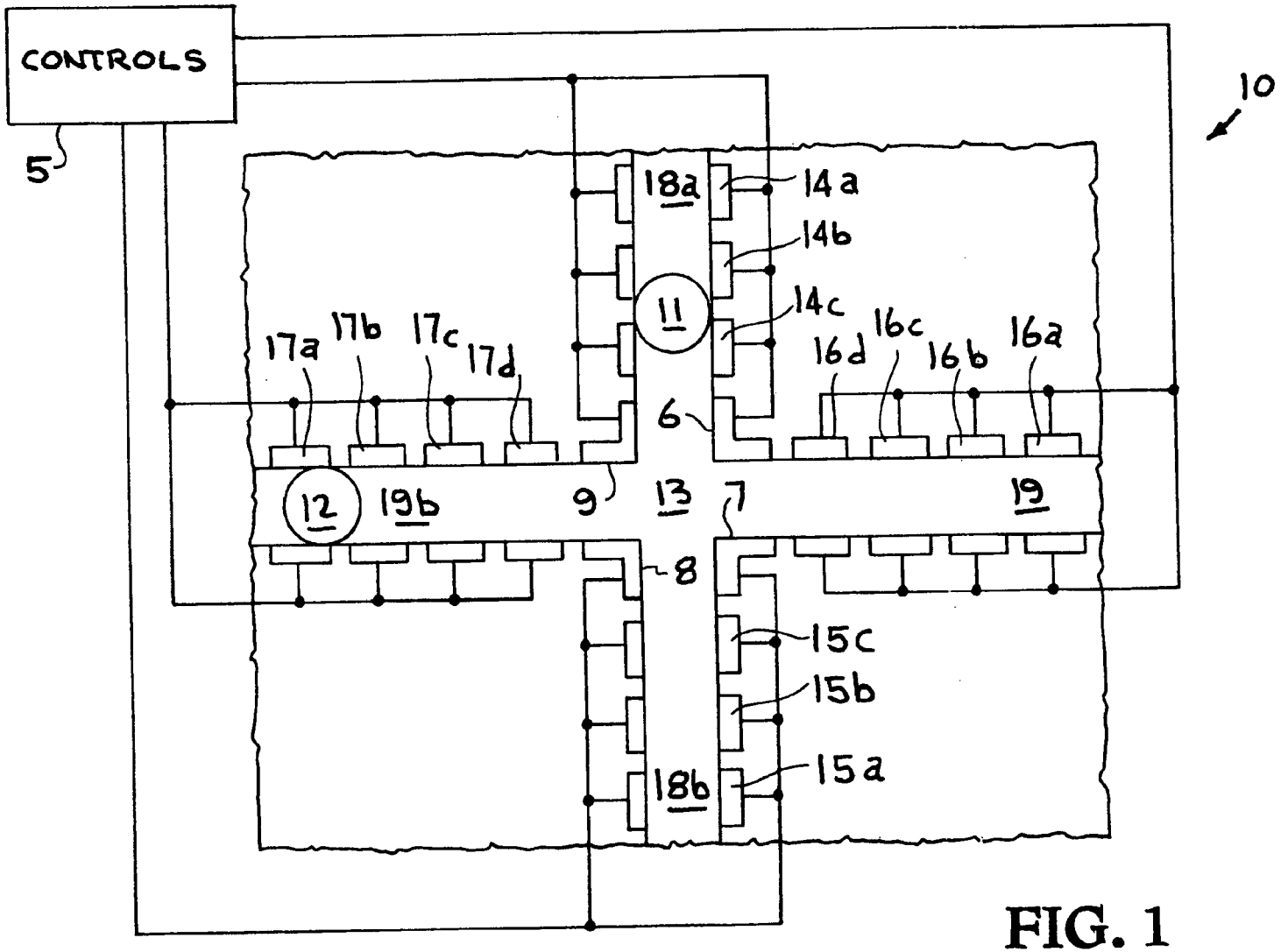
FIG. 1 illustrates an embodiment of a system incorporating the present invention.

Referring now to the drawings, to the following detailed information, and to incorporated materials; a detailed description of the invention, including specific embodiments, is presented. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

One embodiment of a system incorporating the present invention is illustrated in FIG. 1. The system illustrated in FIG. 1 is designated generally by Oft the reference numeral 10. The system 10 provides microscale mixing of chemicals. The system 10 provides the microscale mixing of chemicals accomplished through microfluidics.

Microfluidics is the field of manipulating fluid samples and reagents in minute quantities. The system 10 has uses in the medical, pharmaceutical, chemical, and other fields. For example, the system 10 can be used for an array of antigen-antibody reactions, combinatorial chemistry, drug testing, medical and biological diagnostics, combinatorial chemistry. A specific example of microfluidics is manipulating fluid samples and reagents in minute quantities in micromachined channels to enable hand-held bioinstrumentation and diagnostic tools with quicker process speeds. The ultimate goal is to integrate pumping, valving, mixing, reaction, and detection on a chip for biotechnological, chemical, environmental, and health care applications. Other examples of systems and processes that can utilize the system 10 include inkjet printers, blood-cell-separation equipment, biochemical assays, chemical synthesis, genetic analysis, drug screening, electrochromatography, surface micromachining, laser ablation, and mechanical micromilling.

As illustrated in FIG. 1, the system 10 enables the mixing of droplets 11 and 12. Droplet 11 is initially in channel 18A and droplet 12 is initially in channel 19B. By utilizing a sequential set of MHD pumps 14A, 14B, 14C, 15A, 15B, 15C, 16A, 16B, 16C, 16D, 17A, 17B, 17C, 17D, 6, 7, 8, and 9; droplets 11 and 12 are moved along the microfluidic channels 18A and 19B into the intersection 13 of the channels. Controls 5 are utilized to sequentially actuate and control MHD pumps 14A, 14B, 14C, 15A, 15B, 15C, 16A, 16B, 16C, 16D, 17A, 17B, 17C, 17D, 6, 7, 8, and 9. Droplets 11 and 12 are mixed in the intersection 13. This provides precise mixing of the chemicals that make up the droplets 11 and 12 because micro amounts are mixed together. Evaporation can be a serious problem. The microchannels 18A and 19B with MHD pumps 14A, 14B, 14C, 15A, 15B, 15C, 16A, 16B, 16C, 16D, 17A, 17B, 17C, 17D, 6, 7, 8, and 9 are covered with glass to solve the evaporation problem.

The system 10 provides a method of mixing a first substance and a second substance. A first droplet of the first substance is drawn into a first channel. A second droplet of the second substance is drawn into a second channel. A mixing area is operatively connected to the first channel and the second channel. A third channel is operatively connected to the mixing area. The first droplet is moved along the first channel into the mixing area using a magnetohydrodynamic force. The second droplet is moved along the second channel into the mixing area using a magnetohydrodynamic force. The first droplet and the second droplet are moved into the mixing area to provide a mixture of the first substance and the second substance. The system 10 is not limited to mixing only two droplets and includes cases where two or more droplets are mixed. The mixture of the first substance and the second substance is moved from the mixing area through the third channel using a magnetohydrodynamic force.

The system 10 is not limited to mixing only two droplets and includes cases where two or more droplets are mixed. The system 10 provides a method of mixing a first substance and a second substance. A first substance is drawn into a first channel. The first substance can be a single droplet or a multiplicity of droplets. A second substance is drawn into a second channel. The second substance can be a single droplet or a multiplicity of droplets. A mixing area is operatively connected to the first channel and the second channel. A third channel is operatively connected to the mixing area. The first substance is moved along the first channel into the mixing area using a magnetohydrodynamic force. The second substance is moved along the second channel into the mixing area using a magnetohydrodynamic force. The first substance and the second substance are moved into the mixing area to provide a mixture of the first substance and the second substance. The mixture of the first substance and the second substance is moved from the mixing area through the third channel using a magnetohydrodynamic force.

Pumps can be complicated, both, in fabrication and design, and often are difficult to reduce in size, negating many integrated fluidic applications. Most pumps have a moving component to indirectly pump the fluid, generating pulsatile flow instead of continuous flow. With moving parts involved, dead volume is often a serious problem, causing cross-contamination in biological sensitive processes.

The system 10 demonstrates the use of an AC MHD micropump in which the Lorentz force is used to propel an electrolytic solution along a microchannel. The pumping mechanism for a MHD pump results from the Lorentz force. This force is produced when an electric current is applied across a channel filled with conducting solution in the presence of a perpendicular magnetic field. The Lorentz force is both perpendicular to the current in the channel and the magnetic field, and is given by the equation:

$$F=I\times Bw$$

where I is electric current across the channel (measured in amperes), B is the magnetic field (measured in Tesla) and w is the distance between the electrodes.

In the microscale, the MHD forces are substantial and can be used for propulsion of fluids through microchannels. The MHD forces can be used as actuators, such as a micropump, micromixer, or microvalve, or as sensors, such as a microflow meter, or viscosity meter. This advantageous scaling phenomenon also lends itself to micromachining by integrating microchannels with micro-electrodes. When electrodes are mismatched in the flow direction, a resultant swirling or mixing motion is produced for vortex generation.

Mixing of small volumes of samples is a critical part of microfluidics systems. The system 10 provides an AC MHD driven droplet mixer that can facilitate mixing an array of different samples with an array of another set of different samples. The droplets can be of a specific volume and their movement can be controlled by turning on and controlling different MHD electrode pairs sequentially. Some examples of the use of the system 10 include testing an array of antigen-antibody reactions, drug testing, medical and biological diagnostics, and combinatorial chemistry. In other embodiments of the invention, the system 10 is integrated into several AC MHD micropump systems for complex fluidic routings. The system 10 has uses in the medical, pharmaceutical, chemical, and other fields. For example, the system 10 can be used manipulating fluid samples and reagents in minute quantities in micromachined channels to integrate pumping, valving, mixing, reaction, and detection on a chip for biotechnological, chemical, environmental, and health care applications. Other examples of systems and processes that can utilize the system 10 include inkjet printers, blood-cell-separation equipment, biochemical assays, chemical synthesis, genetic analysis, drug screening, electrochromatography, surface micromachining, laser ablation, and mechanical. The system 10 utilizes micromilling and MHD forces to enable hand-held bioinstrumentation and diagnostic tools with quicker process speeds.

Referring again to FIG. 1, the system 10 provides an AC MHD micropump using the Lorentz force produced by applying an AC current to the sequential set of MHD pumps 14A, 14B, 14C, 15A, 15B, 15C, 16A, 16B, 16C, 16D, 17A, 17B, 17C, 17D, 6, 7, 8, and 9 across the microchannels 18A, 18B, 19A and 19B. The MHD pumps include electrode pairs in the presence of an AC magnetic field. Using controls 5 to actuate and control MHD pumps 14A, 14B, 14C, 15A, 15B, 15C, 16A, 16B, 16C, 16D, 17A, 17B, 17C, 17D, 6, 7, 8, and 9; the droplets 11 and 12 can be mixed and transported.

By controlling the sequential set of MHD pumps 14A, 14B, 14C and 6 along the microfluidic channel 18A the droplet 11 can be manipulated along microchannel 18A using the Lorentz Force. Droplet 11 is transported by utilizing controls 5 to turn on and off the sequential MHD pumps 14A, 14B, 14C and 6. Controls 5 are used to control the magnetic field and to control the force produced by MHD pumps 14A, 14B, 14C and 6.

By controlling the sequential set of MHD pumps 17A, 17B, 17C, 17D and 9 along the microfluidic channel 19B the droplet 12 can be manipulated along microchannel 19B using the Lorentz Force. Droplet 12 is transported along microchannel 19B by utilizing controls 5 to turn on and off sequential MHD pumps 17A, 17B, 17C, 17D and 9. Controls 5 are used to control the magnetic field and to control the force produced by MHD pumps 17A, 17B, 17C, 17D and 9.

The droplets 11 and 12 are transported into the mixing area 13 where they are mixed. The mixed droplets are transported out of the system 10 through micro channel 19A or 19B. By controlling the sequential set of MHD pumps 16A, 16B, 16C, 16D, 6 and 7 along the microfluidic channel 19A the mixed droplets are manipulated along microchannel 19A using the Lorentz Force. The mixed droplets are transported along microchannel 19A by utilizing controls 5 to turn on and off sequential MHD pumps 16A, 16B, 16C, 16D, 6 and 7. By controlling the sequential set of MHD pumps 15A, 15B, 15C, 7, and 8 along the microfluidic channel 18B the mixed droplets are manipulated along microchannel 18B using the Lorentz Force. The mixed droplets are transported along microchannel 18B by utilizing controls 5 to turn on and off sequential MHD pumps 15A, 15B, 15C, 7, and 8. The system 10 allows two different droplets to be mixed autonomously allowing for different arrays of samples to be mixed with another array of different samples. The system 10 can be used to create precisely mixed pharmaceuticals, chemicals, compounds, and other mixtures. The system 10 has uses in the medical, pharmaceutical, chemical, and other fields.

Figure 2A:
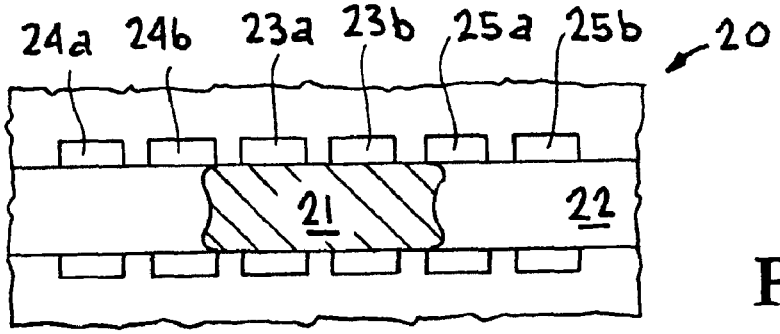
FIGS. 2A, 2B, and 2C illustrate a droplet splitter in a MHD micofluidic channel.
Figure 2B:
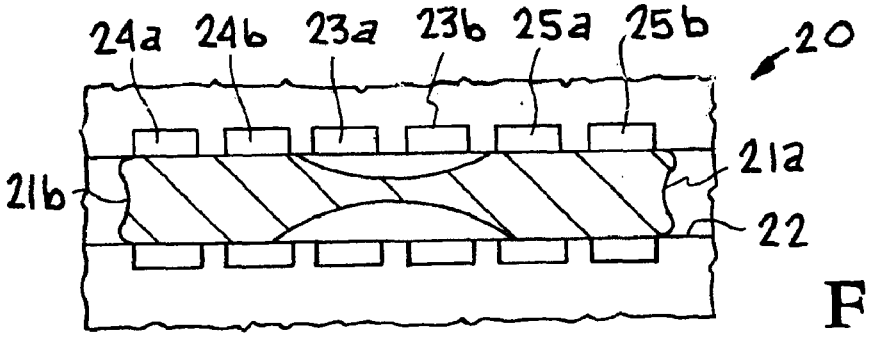
Figure 2C:
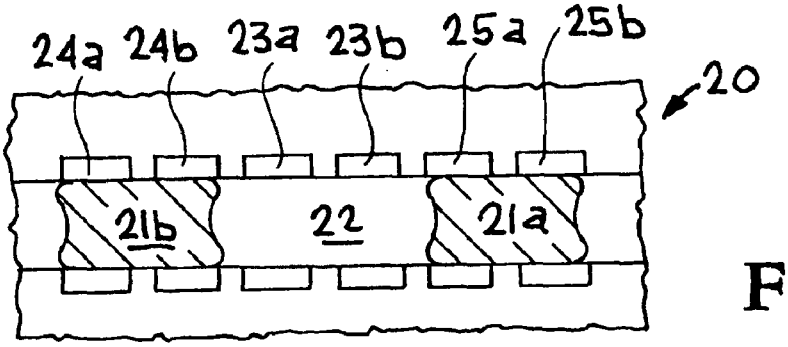

FIGS. 2A, 2B, and 2C illustrate a droplet splitter in a MHD micofluidic channel. The droplet splitter is designated generally by the reference numeral 20. An initial droplet 21 is initially in channel 22. By utilizing a sequential set of MHD pumps 23A, 23B, 24A, 24B, 25A, and 25B droplet 21 is moved along microfluidic channel 22. The MHD pumps 23A, 23B, 24A, 24B, 25A, and 25B provide a MHD micropump in which the Lorentz force is used to propel the droplet 21 along the microchannel 22. A set of controls, similar to the controls 5 shown in FIG. 1, are used to turn on and off sequential the MHD pumps 23A, 23B, 24A, 24B, 25A, and 25B. The pumping mechanism for the MHD pump results from the Lorentz force. This force is produced when an electric current is applied across a channel filled with conducting solution in the presence of a perpendicular magnetic field. The Lorentz force is both perpendicular to the current in the channel and the magnetic field, and is given by the equation:

$$F=I\times Bw$$

where I is electric current across the channel (measured in amperes), B is the magnetic field (measured in Tesla) and w is the distance between the electrodes.

As shown in FIG. 2B, by utilizing the sequential set of MHD pumps 23A, 23B, 24A, 24B, 25A, and 25B; the droplet 21 is initially stretched into components 21A and 21B. The controls are used to selectively activate and control the MHD pumps 23A, 23B, 24A, 24B, 25A, and 25B to stretch the droplet 21 into components 21A and 21B. As shown by FIG. 2B, the droplet 21 is stretched until components 21A and 21B become separate droplets. The controls are used to selectively activate and control the MHD pumps 23A, 23B, 24A, 24B, 25A, and 25B to stretch the droplet 21 until components 21A and 21B become separate droplets.

Figure 3A:
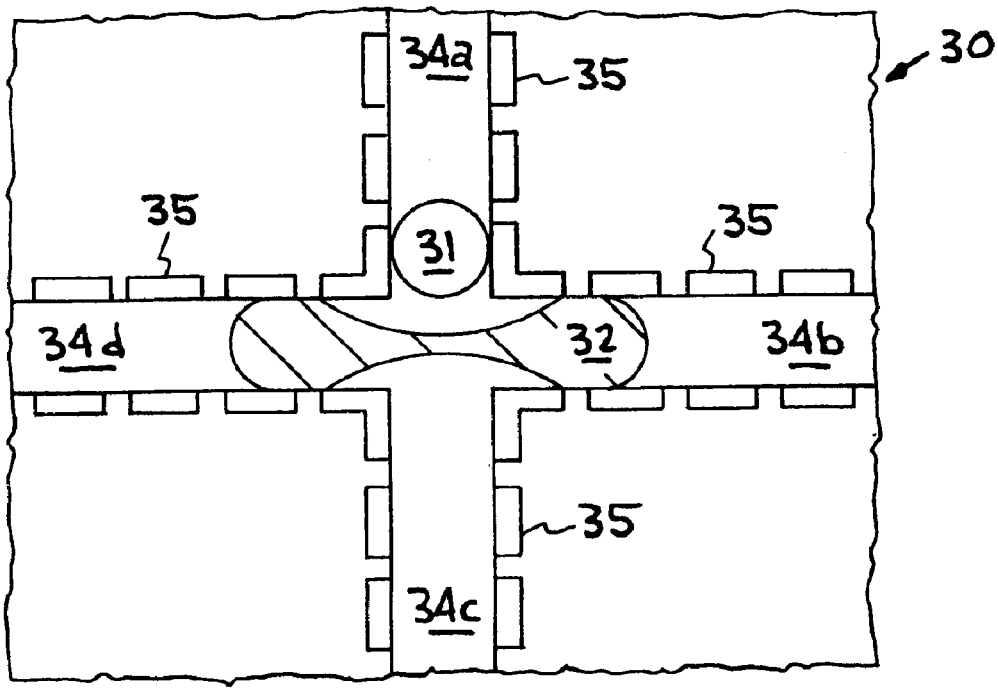
FIGS. 3A and 3B illustrate a droplet mixer enhanced by stretching one droplet to engulf another.
Figure 3B:
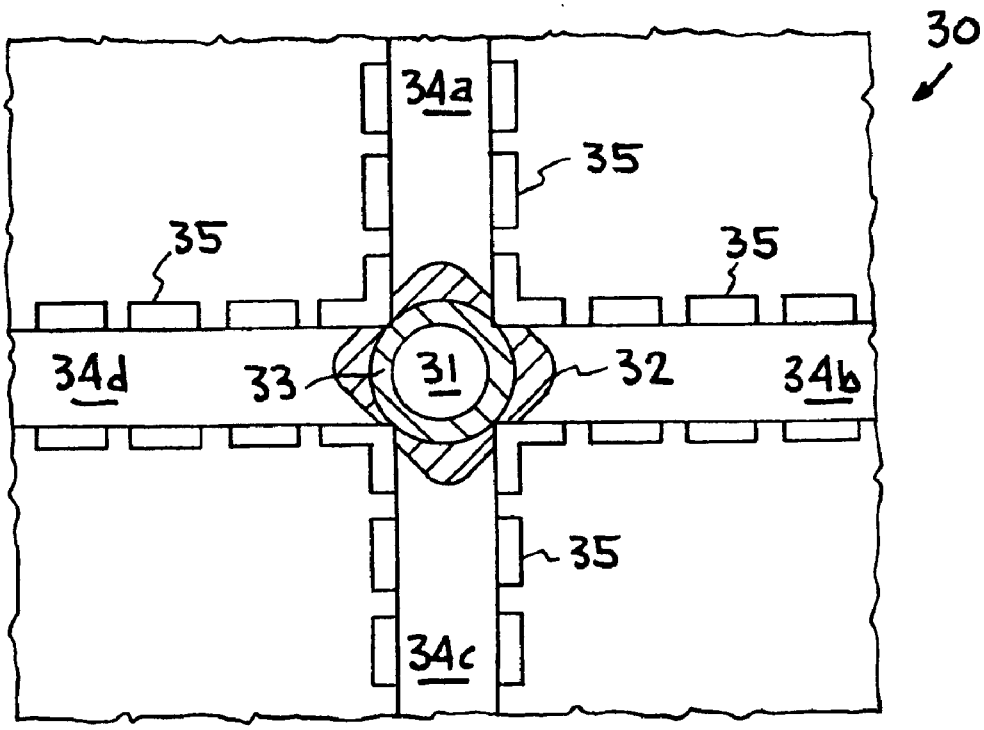

FIGS. 3A and 3B illustrate a droplet mixer enhanced by stretching one droplet to engulf another. The droplet mixer is designated generally by the reference numeral 30. A droplet 31 is initially in channel 34A. By utilizing a sequential set of MHD pumps 35, droplet 31 is moved along microfluidic channel 34A. The MHD pumps 35 provide a MHD micropump in which the Lorentz force is used to propel the droplet 31 along the microchannel 34A. A set of controls, similar to the controls 5 shown in FIG. 1, are used to turn on and off sequential the MHD pumps 35 and to control the Lorentz force.

As shown in FIG. 3A, by utilizing the sequential set of MHD pumps 35, the droplet 32 is moved through microchannel 34B and initially stretched into two separate component sections. The controls are used to selectively activate and control the MHD pumps 35 to stretch the droplet 32 into the two components. The droplet 31 is moved through microchannel 34A toward droplet 32.

As shown in FIG. 3B, by utilizing the sequential set of MHD pumps 35, the droplet 31 is moved into contact with droplet 32 between the two separate component sections of droplet 32. The sequential set of MHD pumps 35 is used to combine droplet 31 and droplet 32. As shown by FIG. 3B the portions of droplet 32 and droplet 32 begin to combine to from a mixed material 33.

Figure 4:
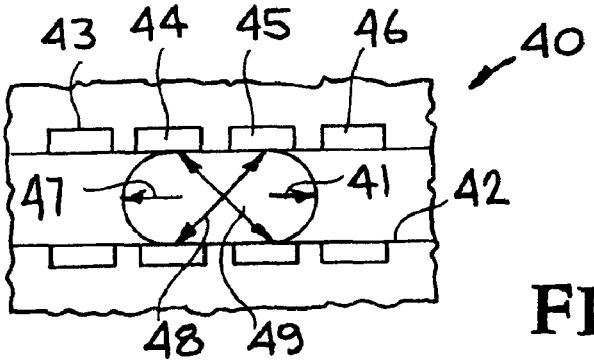
FIG. 4 illustrates MDH forces induced in various directions for enhanced mixing with droplets.

FIG. 4 illustrates MDH forces induced in various directions for enhanced mixing with droplets. The illustration is designated generally by the reference numeral 40. A droplet 41 is located in channel 42. By utilizing a sequential set of MHD pumps 43, 44, 45, and 46; droplet 41 can be manipulated in microfluidic channel 42. The MHD pumps 43, 44, 45, and 46 provide a MHD micropump in which the Lorentz force is used to manipulate the droplet 41. A set of controls, similar to the controls 5 shown in FIG. 1, are used to turn on and off sequential and to control the MHD pumps 43, 44, 45, and 46. Voltage differentials are created. As illustrated in FIG. 4, voltages $V_0$ and $V_2$ produce a force along the axis 48. Voltages $V_1$ and $V_3$ produce a force along the axis 49. By utilizing the sequential set of MHD pumps 43, 44, 45, and 46; the droplet 41 is stretched and elongated. The forces along axes 48 and 49 can be used to move droplet 41 in microchannel 42. Controls can be used to selectively activate and control the MHD pumps to stretch the droplet 41 into separate components and to mix droplet 41 with other droplets.

Figure 5A:
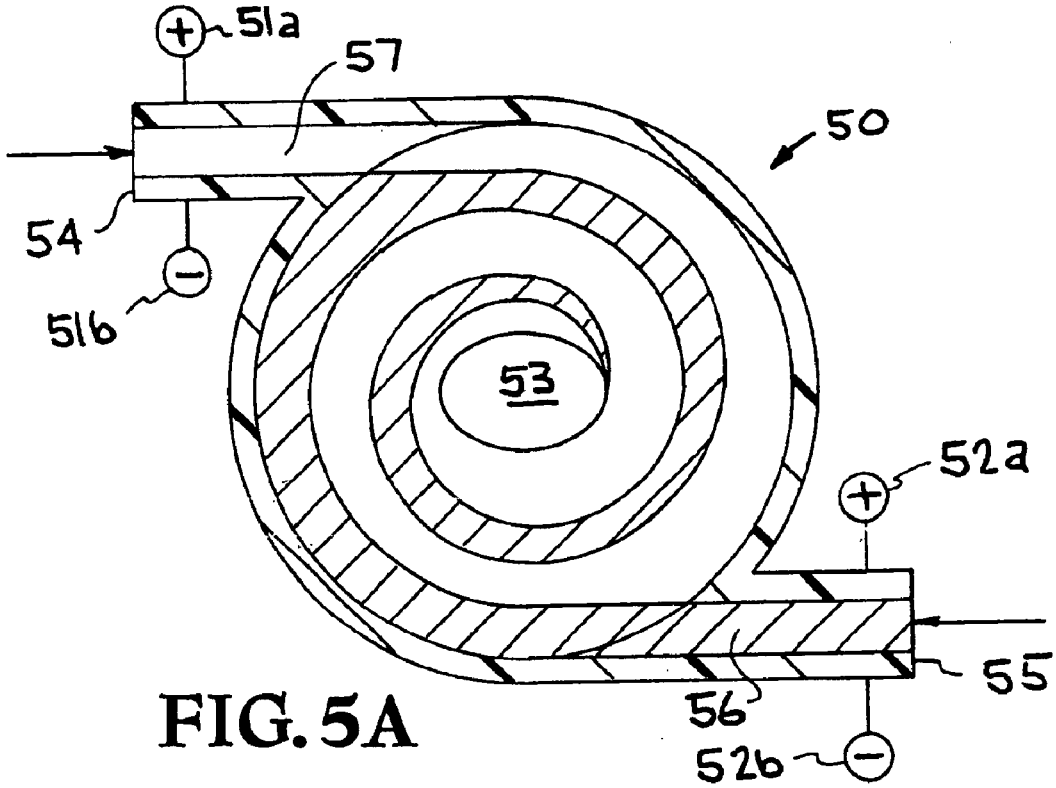
FIGS. 5A and 5B illustrate a MHD spiraling centrifuge (MSC) for enhanced mixing.
Figure 5B:
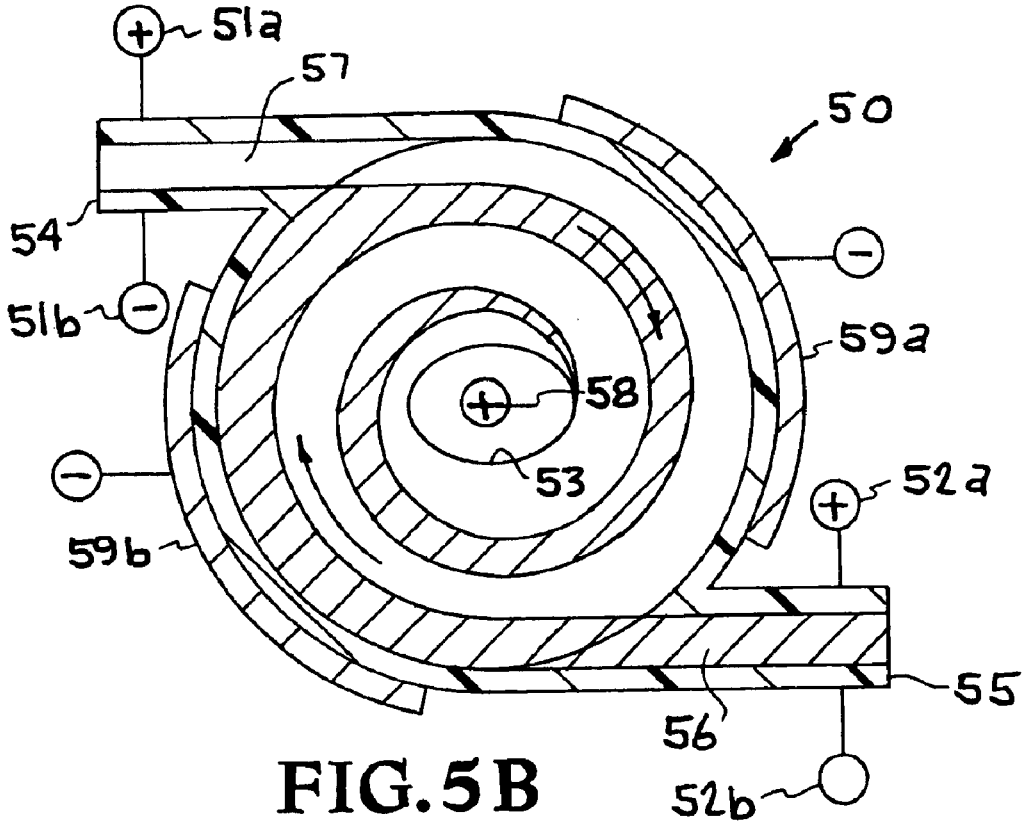

FIGS. 5A and 5B illustrate a MHD spiraling centrifuge (MSC) for enhanced mixing. The MHD spiraling centrifuge (MSC) is designated generally by the reference numeral 50. Droplets are delivered to MSC for mixing based on stretched laminar flow lines reducing the diffusion length scales. The MSC 50 provides a magnetohydrodynamic fluidic system for mixing a first sample 57 and a second sample 56. A first substrate section includes a first flow channel 54 and a first plurality of pairs of spaced electrodes 51. A second substrate section includes a second flow channel 55 and a second plurality of pairs of spaced electrodes 52. A third substrate section includes a third flow channel 53 and a first plurality of pairs of spaced electrodes. A magnetic section is operatively connected to the first, second, and third MHD pumps. A control section is provided to selectively activate and control the MHD pumps.

The first substrate section 54, the second substrate section 55, the third substrate section, the first plurality of pairs of spaced electrodes 51, the second plurality of pairs of spaced electrodes 52, the third plurality of pairs of spaced electrodes, the magnetic section, and the control section are operatively connected to move the first sample 57 through the first flow channel 54, the second sample 56 through the second flow channel, and both the first sample 57 and the second sample 56 into the third flow channel 53 where they are mixed. The first substrate section 57, the second substrate section 55, and the third substrate section 53 are connected at an angle to each other. The first substrate section 75 and the second substrate section 55 are in a common plane. The third substrate section 53 is in a second plane at an angle to the first common plane. The MHD spiraling centrifuge (MSC) 50 provides enhanced mixing. Droplets are delivered to MSC 50 for mixing based on stretched laminar flow lines reducing the diffusion length scales.

Referring in particular to FIG. 5B, the MHD spiraling centrifuge (MSC) 50 for enhanced mixing utilizes two microchannels 56 and 57 to deliver fluids to be mixed in a circular mixing chamber 53. This provides stretched laminar flow lines reducing the diffusion length scales. The MSC 50 includes MHD electrode pairs 51*a* & 51*b* and MHD electrode pairs 52*a* & 52*b* that deliver opposing laminar flow streams that result in a spiral (swiss roll) fashion to induce mixing. Mixing is further enhanced by adding a center post electrode 58 and circumferential electrodes 59*a* & 59*b*. Electrodes 59*b* & 58 form a MHD electrode pair (59*b*/58 Pair) and electrodes 59*a* & 58 form a MHD electrode pair (59*a*/58 Pair). Applying current to these two electrode pairs result in a centrifugal propulsion around electrode post 58 in the mixing chamber.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A magnetohydrodynamic fluidic system for mixing a first substance and a second substance comprising:

a first substrate section having a first flow channel and a first plurality of MHD pumps operatively connected to said first flow channel, a second substrate section having a second flow channel and a second plurality of MHD pumps operatively connected to said second flow channel, a third substrate section having a third flow channel and a third plurality of MHD pumps operatively connected to said third flow channel, wherein said first substrate section, said second substrate section, and said third substrate section are connected at an angle to each other, and with said first and second substrate sections being in a first common plane and said third substrate section being in a second plane at an angle to the first common plane a control section, said first substrate section, said second substrate section, said third substrate section, said first plurality of MHD pumps, said second plurality of MHD pumps, said third plurality of MHD pumps, and said control section being operatively connected to move said first substance through said first flow channel, said second substance through said second flow channel, and both said first substance and said second substance into said third flow channel where they are mixed.

2. A magnetohydrodynamic fluidic system for mixing a first sample and a second sample comprising:

first magnetohydrodynamic substrate means having a first flow channel and a first plurality of pairs of spaced electrodes operatively connected to said first flow channel for moving said first sample through said first flow channel, second magnetohydrodynamic substrate means having a second flow channel and a second plurality of pairs of spaced electrodes operatively connected to said second flow channel for moving said second sample through said second flow channel, third magnetohydrodynamic substrate means having a third flow channel and a third plurality of pairs of spaced electrodes operatively connected to said third flow channel for moving both said first sample and said second sample through said third flow channel, wherein said first magnetohydrodynamic substrate means, said second magnetohydrodynamic substrate means, and said third magnetohydrodynamic substrate means are connected at an angle to each other with said first and second substrate means being in a first common plane and said third substrate means being in a second plane at an angle to the first common plane, magnetic means operatively connected to said first magnetohydrodynamic substrate means, said second magnetohydrodynamic substrate means, and said third magnetohydrodynamic substrate means for providing a magnetohydrodynamic force to said first sample and said second sample, control means for selectively controlling said first plurality of pairs of spaced electrodes, said second plurality of pairs of spaced electrodes, and said third plurality of pairs of spaced electrodes to move said first sample through said first flow channel, to move said second sample through said second flow channel, and to move both said first sample and said second sample into said third flow channel where they are mixed.

3. A magnetohydrodynamic fluidic system for mixing a first sample and a second sample comprising:

a first channel for directing a first droplet of a chemical and/or material, a first channel for directing a second droplet of a chemical and/or material, a mixing area operatively connected to said first channel and said second channel, a third channel operatively connected to said mixing area, wherein said first channel, and said second channel are in a first common plane, and said third channel is in a second plane at an angle to said first common plane, a first plurality of pairs of spaced electrodes operatively connected to said first channel for moving said first droplet along said first channel into said mixing area by creating a magnetohydrodynamic force, a second plurality of pairs of spaced electrodes operatively connected to said second channel for moving said second droplet along said second channel into said mixing area by creating a magnetohydrodynamic force, and a third plurality of pairs of spaced electrodes operatively connected to said third channel for moving said mixed chemical and/or material along said third channel by creating a magnetohydrodynamic force.

4. A magnetohydrodynamic fluidic method for mixing a first sample and a second sample, comprising the steps of:

using a first magnetohydrodynamic unit with a first flow channel and a first plurality of pairs of spaced electrodes operatively connected to said first flow channel to move said first sample through said first flow channel, using a second magnetohydrodynamic unit with a second flow channel and a second plurality of pairs of spaced electrodes operatively connected to said second flow channel to move said second sample through said second flow channel, and mixing said first sample and said second sample by using said first magnetohydrodynamic unit and said second magnetohydrodynamic unit to bring said first sample and said second sample together causing the samples to be mixed, wherein said first sample and said second sample are mixed by a spiraling centrifuge.

5. A method of mixing chemicals and/or materials comprising the steps of:

providing a first chemical and/or material in a first channel, providing a second chemical and/or material in a second channel, providing a mixing area operatively connected to said first channel and said second channel, providing a third channel operatively connected to said mixing area, moving said first chemical and/or material along said first channel into said mixing area using a magnetohydrodynamic force, moving said second chemical and/or material along said second channel into said mixing area using a magnetohydrodynamic force, mixing said first chemical and/or material and said second chemical and/or material in said mixing area to provide a mixed chemical and/or material, wherein said first chemical and/or material and said second chemical and/or material are mixed by a spiraling centrifuge, and moving the mixed chemical and/or material from said mixing area through said third channel using a magnetohydrodynamic force.

* * * * *